US006182332B1

(12) United States Patent
Jander

(10) Patent No.: US 6,182,332 B1
(45) Date of Patent: Feb. 6, 2001

(54) METHOD OF FORMING DISCRETE LENGTH FIBERS

(75) Inventor: Michael Horst Jander, Eupen (BE)

(73) Assignee: Owens Corning Composites SPRL, Brussels (BE)

( * ) Notice: Under 35 U.S.C. 154(b), the term of this patent shall be extended for 0 days.

(21) Appl. No.: 09/364,121

(22) Filed: Jul. 30, 1999

(51) Int. Cl.[7] ..... D01G 1/00
(52) U.S. Cl. ..... 19/60; 19/0.62; 83/913
(58) Field of Search ..... 19/0.3, 0.56, 0.58, 19/0.6, 0.62; 57/2; 83/913, 950

(56) References Cited

U.S. PATENT DOCUMENTS

| | | | | |
|---|---|---|---|---|
| 3,557,648 | * | 1/1971 | Coffin et al. | 83/913 |
| 3,733,945 | * | 5/1973 | Cook | 83/913 |
| 3,744,361 | * | 7/1973 | Van Doorn et al. | 83/913 |
| 3,826,163 | * | 7/1974 | Spaller, Jr. et al. | 83/913 |
| 3,861,257 | * | 1/1975 | Laird et al. | 83/913 |
| 3,915,042 | * | 10/1975 | Laird | 83/913 |
| 3,942,401 | | 3/1976 | Roncato . | |
| 4,014,231 | * | 3/1977 | Hutzezon | 83/913 |
| 4,188,845 | * | 2/1980 | Stukenberg | 83/913 |
| 4,237,758 | * | 12/1980 | Lindner et al. | 83/913 |
| 4,577,537 | | 3/1986 | Bauch . | |
| 5,450,777 | * | 9/1995 | Molnar et al. | 83/913 |
| 5,806,387 | | 9/1998 | Jander . | |
| 5,819,614 | | 10/1998 | Jander . | |
| 5,836,225 | * | 11/1998 | Molnar et al. | 83/913 |

FOREIGN PATENT DOCUMENTS

| | | |
|---|---|---|
| WO 96/02474 | 2/1996 | (WO) . |
| WO 96/02475 | 2/1996 | (WO) . |
| WO 96/02476 | 2/1996 | (WO) . |
| WO 95/01939 | 1/1998 | (WO) . |

* cited by examiner

*Primary Examiner*—Danny Worrell
*Assistant Examiner*—Gary L. Welch
(74) *Attorney, Agent, or Firm*—Inger H. Eckert

(57) ABSTRACT

In a method of forming discrete length fibers, a first engagement member is moved in orbit relative to a second engagement member. A continuous fiber is positioned between the first and second engagement members. The fiber is engaged between the first and second engagement members to cut it into discrete length fibers.

27 Claims, 6 Drawing Sheets

METHOD OF FORMING DISCRETE LENGTH FIBERS

APPLICABILITY OF THE INVENTION

This invention relates to a method of forming discrete length fibers, and in particular to a method of forming discrete length reinforcement fibers suitable for use in reinforcement mats, reinforcement preforms, and other types of reinforcement structures.

BACKGROUND OF THE INVENTION

Discrete length reinforcement fibers are useful in the manufacture of many different types of reinforcement structures. For example, the fibers can be used in reinforcement mats for reinforcing articles such as roofing shingles. The reinforcement mats can be made with a single type of fiber, with commingled fibers of different types (e.g., carbon fibers and thermoplastic fibers), or with layers of different types of fibers.

The discrete length reinforcement fibers can also be used in reinforcement preforms. Structural composites and other reinforced molded articles are commonly made by resin transfer molding or structural resin injection molding. These molding processes have been made more efficient by first creating a reinforcement fiber preform that is the approximate shape and size of the molded article, inserting the preform into the mold, and injecting the resin into the mold around the preform.

Discrete length fibers for reinforcement structures are typically formed by cutting a continuous fiber of reinforcement material into discrete lengths. An apparatus for cutting and dispensing discrete length reinforcement fibers is commonly known as a "chopper". The chopper usually includes a mechanism for feeding the continuous fiber, multiple cutting blades for cutting the fiber into discrete lengths, and a mechanism for dispensing the discrete length fibers. Some choppers allow a change in the length of the discrete length fibers during the cutting operation by changing the speed of the cutting blades relative to the feed rate of the continuous fiber.

A problem commonly associated with choppers is that the cutting blades wear out relatively quickly and must be replaced. This problem is made worse when the speed of the cutting blades is changed relative to the feed rate of the continuous fiber during the cutting operation, because slippage between the accelerating or decelerating cutting blades and the continuous fiber causes increased wear on the cutting blades.

The prior art does not address this problem. For example, published international patent applications WO 95/01939 and WO 96/02475, both assigned to Applicator System AB, disclose choppers in which a continuous fiber is cut between a support roller and a rotary cutter having multiple cutting blades. There is no disclosure of a cutting structure that could reduce the wear on the cutting blades.

Accordingly, it would be desirable to provide a method of forming discrete length fibers that prolongs the lifetime of the cutting blades used in the method. It would particularly be desirable to be able to change the length of the discrete length fibers during the cutting operation without causing increased wear on the cutting blades.

SUMMARY OF THE INVENTION

The above objects as well as other objects not specifically enumerated are achieved by a method of forming discrete length fibers according to the invention. In the method, a first engagement member is moved in orbit relative to a second engagement member. Preferably, the first engagement member is a cutter and the second engagement member is a ring. A continuous fiber is positioned between the first and second engagement members. The continuous fiber is engaged between the first and second engagement members to cut it into discrete length fibers. In a preferred embodiment, the method uses a plurality of first engagement members in cooperation with a second engagement member to form the discrete length fibers.

In another embodiment of the method, a second engagement member is moved in orbit relative to a plurality of first engagement members. A continuous fiber is positioned between the second engagement member and the first engagement members. The continuous fiber is engaged between the second engagement member and the first engagement members to cut it into discrete length fibers.

Various objects and advantages of this invention will become apparent to is those skilled in the art from the following detailed description of the preferred embodiments, when read in light of the accompanying drawings.

DETAILED DESCRIPTION AND PREFERRED EMBODIMENTS OF THE INVENTION

Figure 1:
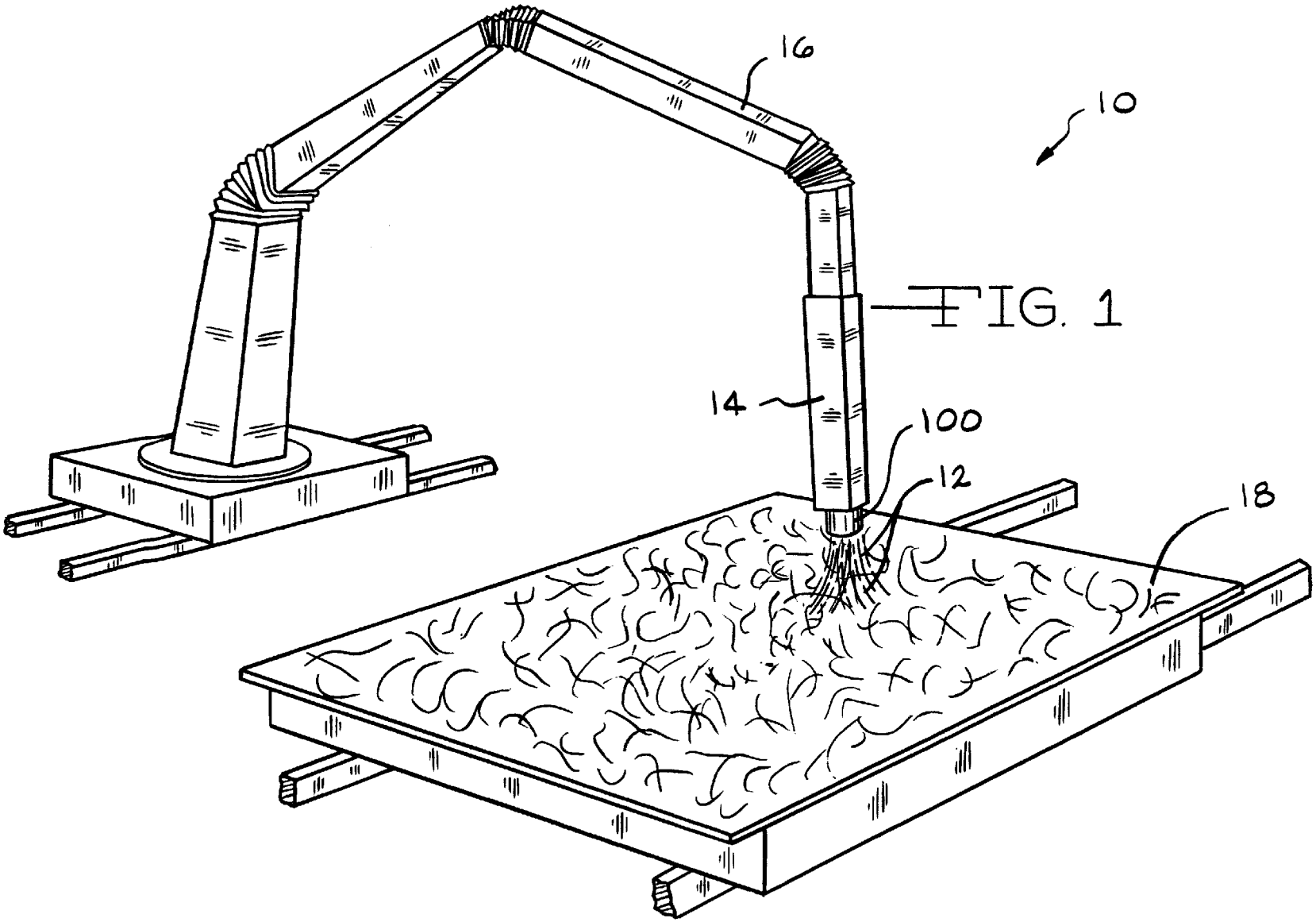
FIG. 1 is a perspective view illustrating the dispensing of discrete length fibers that are formed according to the method of the invention.

Referring to the drawings, FIG. 1 illustrates an apparatus 10 for forming and dispensing discrete length fibers 12 according to the method of the invention. A cutting assembly (not shown in FIG. 1) for forming the discrete length fibers is mounted inside a housing 14 attached to the end of a robot arm 16. The robot arm is positioned to deposit the discrete length fibers onto a collection surface 18, such as a preform molding surface. The robot arm can be provided with a hydraulic system (not shown) or other similar system to enable the arm to be positioned adjacent or above any portion of the collection surface. The movement of the arm can be controlled by a computer (not shown) according to a predetermined pattern so that a desired pattern of discrete length fibers is laid down on the collection surface. The arm need not be robotized or automated, and could even be stationary with the collection surface being moveable.

Figure 2:
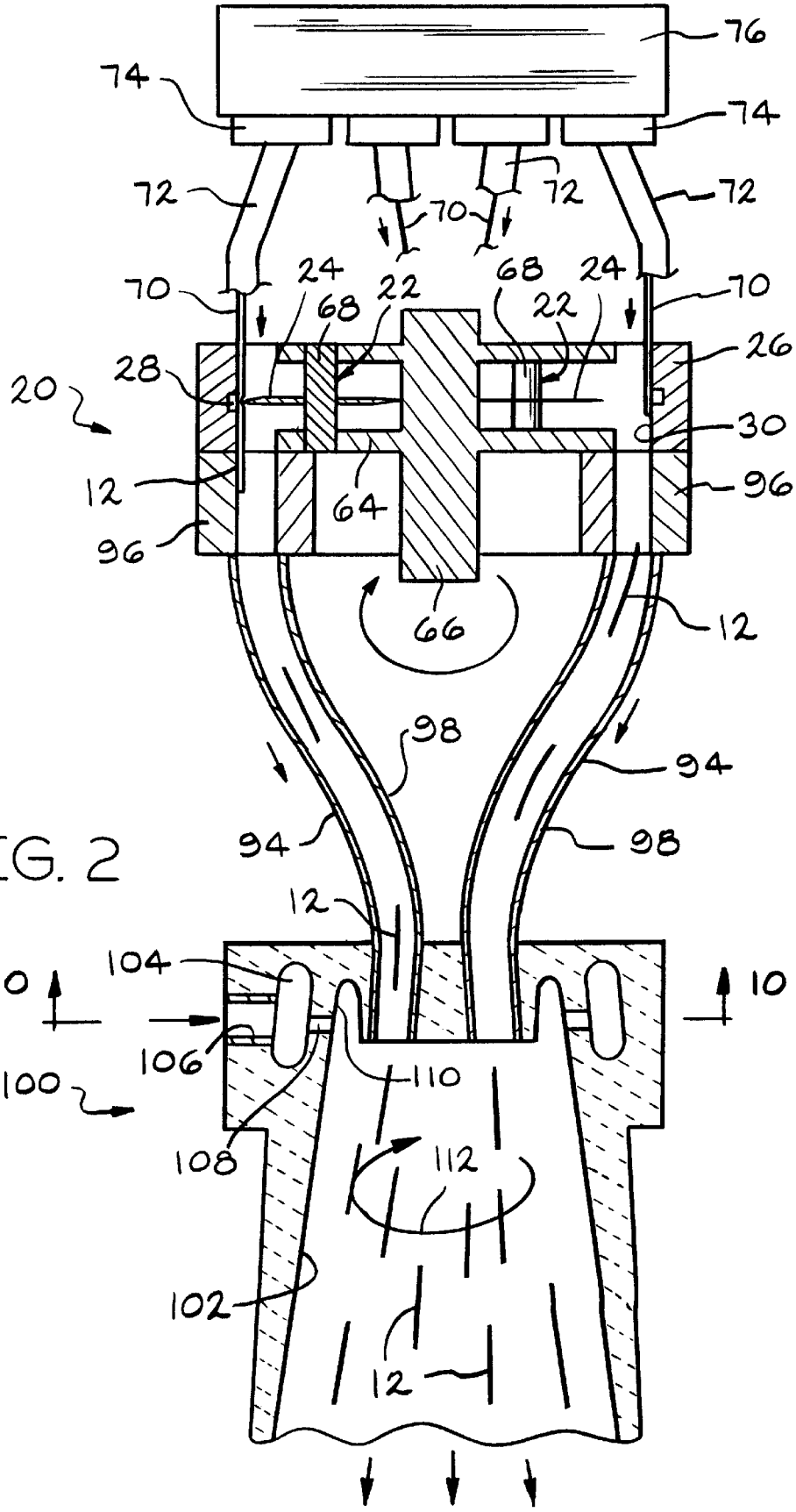
FIG. 2 is a side view showing a mechanism for feeding continuous fibers, a cross-section of a cutting assembly useful for cutting the continuous fibers to form discrete length fibers according to the method of the invention, and a cross-section of a nozzle for dispensing the discrete length fibers.
Figure 3:
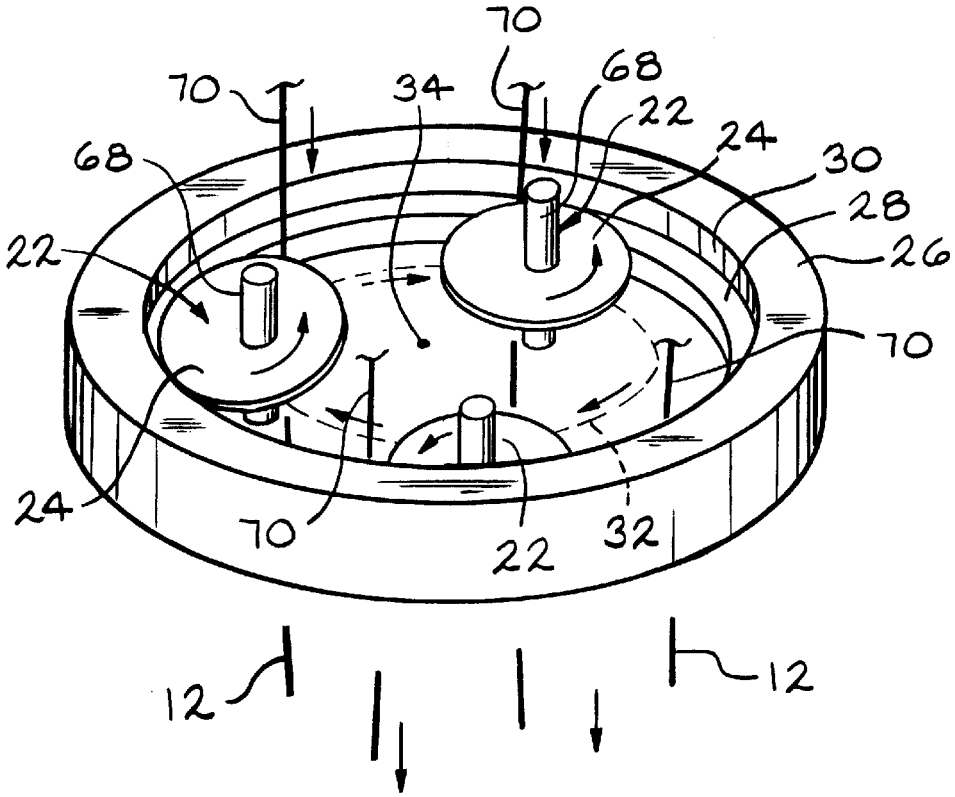
FIG. 3 is a perspective view of a portion of thc cutting assembly of FIG. 2, showing multiple rotary cutters moving in orbit along an inner circumference of a ring to cut continuous fibers into discrete length fibers.

The cutting assembly 20 illustrated in FIGS. 2 and 3 is an example of an apparatus useful for forming discrete length fibers 12 according to the method of the invention. In a first step of the method, a first engagement member is moved in orbit relative to a second engagement member. The term "a first engagement member" means one or more first engagement members, and the term "a second engagement member" means one or more second engagement members. The first and second engagement members are any structures capable of cooperating with each other to engage the continuous fiber and thereby cut it into discrete length fibers.

Preferably, one of the first and second engagement members is a cutter, and the other of the first and second engagement members is a ring. The cutter can be any type capable of cutting the continuous fiber into discrete length fibers. Preferably, the cutter is a rotary cutter including a curved cutting blade. In the embodiment shown in FIGS. 2 and 3, the first engagement members of the cutting assembly are three rotary cutters 22 having circular cutting blades 24. The cutting blades are preferably formed of a metallic material or a hard polymeric material.

The ring can be any suitable size for the cutting operation, and it can be formed from any suitable material, such as a metallic material (e.g., steel) or an elastic material (e.g., rubber or polyurethane). In the illustrated embodiment, the second engagement member is a metallic ring 26 having a backup material 28 positioned in a circumferential groove along the inner circumference 30 of the ring. The backup material facilitates the cutting action between the rotary cutters and the ring. Preferably, the backup material is a material, such as rubber or polyurethane, that is softer than the material of the cutting blades.

In the method of the invention, the first engagement member is moved in orbit relative to the second engagement member. The term "orbit" means that the first engagement member rotates about the center of the second engagement member. The "center" of the second engagement member can be a central point or a central axis. When the first engagement member is a cutter and the second engagement member is a ring, the orbit of the cutter can be located outside or inside the ring. As shown in FIG. 3, the rotary cutters 22 are moved in an orbit 32 about the center 34 of the ring 26, along the inner circumference 30 of the ring. The rotary cutters and ring are similar in structure and operation to a ring gear.

Figure 4:
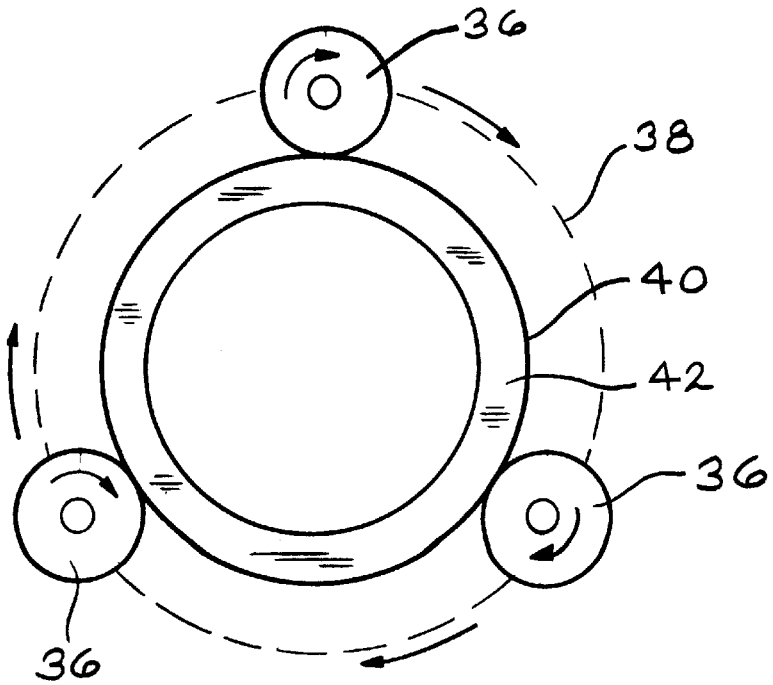
FIG. 4 is a top view of a portion of another embodiment of the cutting assembly, showing multiple rotary cutters moving in orbit around an outer circumference of a ring.
Figure 5:
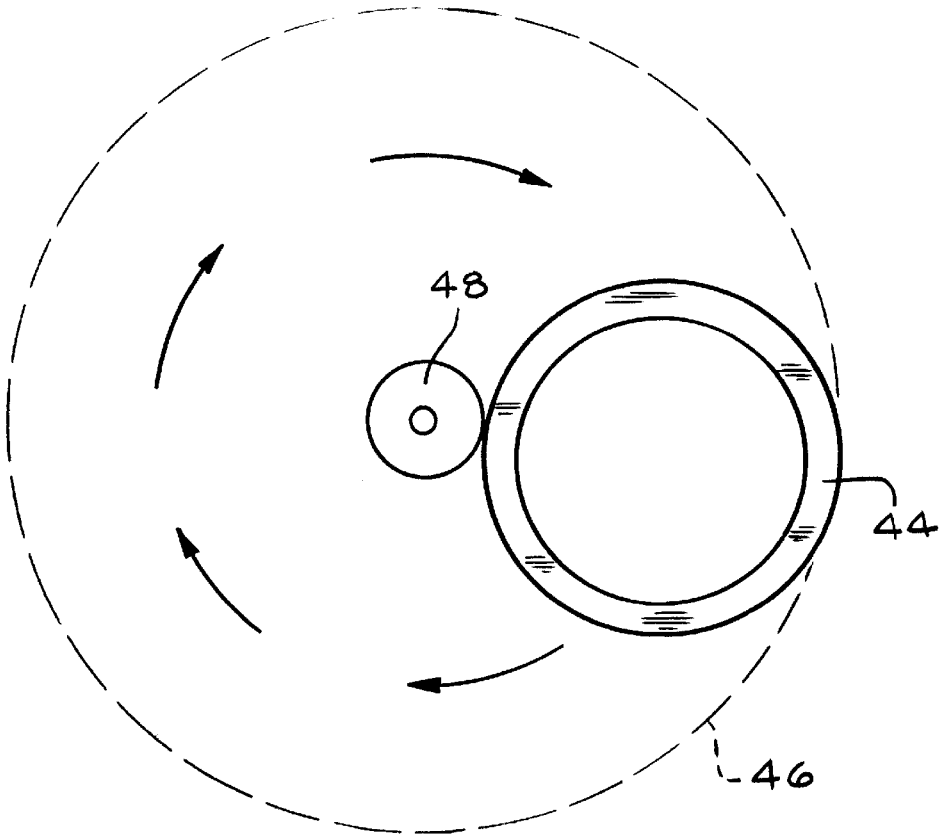
FIG. 5 is a top view of a portion of another embodiment of the cutting assembly, showing a ring moving in orbit around a rotary cutter, with the rotary cutter located outside the ring.
Figure 6:
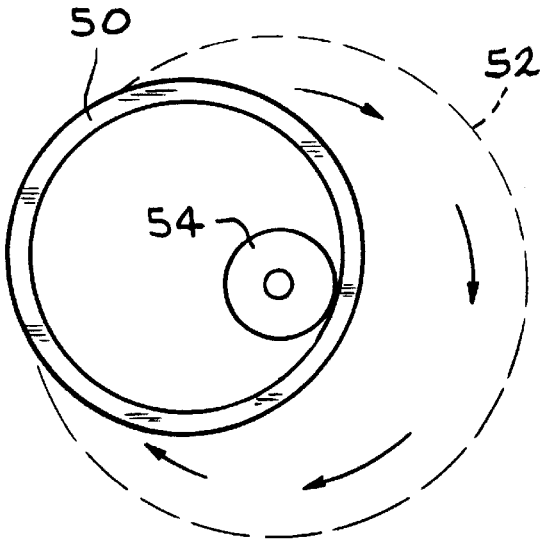
FIG. 6 is a top view of a portion of another embodiment of the cutting assembly, showing a ring moving in orbit around a rotary cutter, with the rotary cutter located inside the ring.
Figure 7:
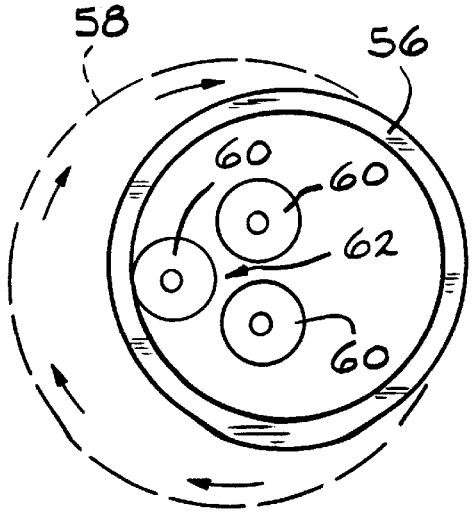
FIG. 7 is a top view of a portion of another embodiment of the cutting assembly, showing a ring moving in orbit around multiple rotary cutters, with the rotary cutters located inside the ring.

FIG. 4 illustrates another embodiment in which three rotary cutters 36 are moved in an orbit 38 around an outer circumference 40 of a ring 42. FIG. 5 illustrates another embodiment in which a ring 44 is moved in an orbit 46 around a rotary cutter 48, with the cutter located outside the ring. FIG. 6 illustrates another embodiment in which a ring 50 is moved in an orbit 52 around a rotary cutter 54, with the cutter located inside the ring. FIG. 7 illustrates another embodiment in which a ring 56 is moved in an orbit 58 around three rotary cutters 60, with the cutters located inside the ring. In this embodiment, the center 62 of the orbit is a point centrally located between the three rotary cutters.

The first engagement member can be moved in orbit relative to the second engagement member by any suitable means. In the embodiment shown in FIGS. 2 and 3, the rotary cutters 22 are moved in orbit by mounting them on a rotor 64 that rotates on an axle 66 inside the ring 26. The rotation of the axle is powered by a motor (not shown) or other power source. Preferably, the speed of movement of the first engagement member is adjustable during the cutting operation to allow a change in the length of the discrete length fibers. In the illustrated embodiment, the speed of movement of the rotary cutters is adjustable during the cutting operation by adjusting the speed of rotation of the axle. The rotation of the axle can be controlled by a computer (not shown) or other controller. In addition to moving in orbit, each of the illustrated rotary cutters 22 is also mounted for rotation about its own axis 68, for a purpose that will be described below.

In a second step of the method, one or more continuous fibers are positioned between the first engagement member and the second engagement member. The continuous fibers can be formed from any suitable fibrous material. In a preferred embodiment, the fibrous material is a reinforcement material suitable for forming reinforcement fibers. One suitable reinforcement material is assembled glass fiber roving, available from Owens Corning, Toledo, Ohio, although other mineral fibers and organic fibers, such as polyester and a man-made organic aramid fiber produced form polyparaphenylene terephthalamide and sold under the tradename KELVAR®, can also be used with the invention. It is to be understood that the continuous fiber can be a single filament (monofilament) or a fiber comprised of numerous filaments. The filaments can be formed from a single material or different types of material, such as commingled glass and polypropylene filaments.

The continuous fibers are usually positioned by continuously feeding them between the first engagement member and the second engagement member. In the embodiment shown in FIGS. 2 and 3, four continues fibers 70 are fed along the inner circumference 30 of the ring 26, between the ring and the rotary cutters 36. The continuous fibers are supplied from a source (not shown) and are transported to the cutting assembly 20 through the robot arm 16. The continuous fibers are then fed to the cutting assembly by any suitable feed means, such as a feeder roll (not shown) alone or in cooperation with a feeder belt (not shown). The feed means can be powered by a motor (not shown) or other power source. Preferably, the rate of feeding the continuous fibers is adjustable during the cutting operation to allow a change in the length of the discrete length fibers. The operation of the feed means can be controlled by a computer (not shown) or other controller. When the continuous fibers are glass fibers, the fibers arc usually fed to the cutting assembly at a rate within a range of from about 5 meters/second to about 20 meters/second, typically about 10 meters/second.

In the embodiment shown in FIGS. 2 and 3, the continuous fibers 70 are fed through feed conduits 72 to control the location of the fibers within the cutting assembly 20. The continuous fibers are fed along the inner circumference 30 of the ring 26 at spaced locations approximately equidistant from one another. Preferably, the continuous fibers are propelled through the feed conduits to avoid problems such as the fibers becoming stuck inside the conduits. In the illustrated embodiment, the continuous fibers are propelled by ejectors 74 mounted inside an ejector housing 76. The ejectors pneumatically propel the continuous fibers through the feed conduits by the use of pressurized air or other pressurized fluid.

Figure 8:
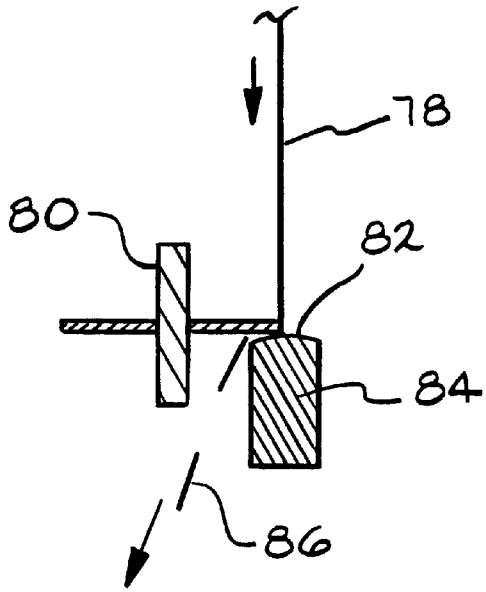
FIG. 8 is a cross-sectional view of a portion of another embodiment of the cutting assembly, showing a continuous fiber engaged between a rotary cutter and a side surface of a ring to shear the continuous fiber into discrete length fibers.

In a third step of the method, the continuous fiber is engaged between the first engagement member and the second engagement member to cut the continuous fiber into discrete length fibers. The continuous fiber can be engaged between any suitable surfaces of the first and second engagement members. The cutting action can be any type suitable for separating the continuous fiber into discrete length fibers, such as crushing, slicing or shearing. In the embodiment shown in FIGS. 2 and 3, the continuous fibers 70 are engaged between the cutting blades 24 of the rotary cutters 22 and the inner circumference 30 of the ring to cut the continuous fibers by a crushing or slicing action. FIG. 8 illustrates another embodiment in which a continuous fiber 78 is engaged between a cutter 80 and a side surface 82 of a ring 84 to shear the continuous fiber into discrete length fibers 86.

Figure 9:
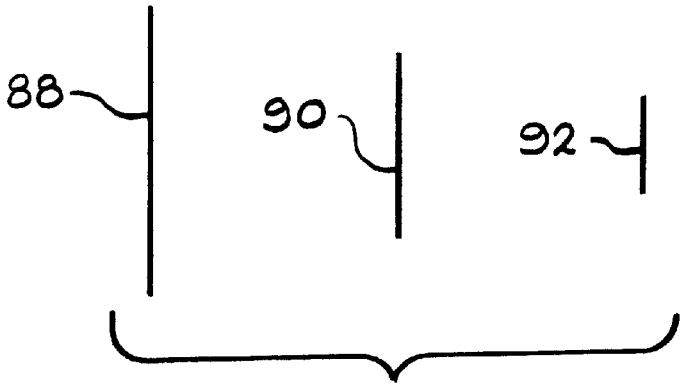
FIG. 9 is a side view of several discrete length fibers cut to different lengths according to the method of the invention.

The continuous fiber can be cut into discrete length fibers of any desired length. A typical length of reinforcement fiber is within the range of from about 15 to about 100 mm. In the embodiment shown in FIGS. 2 and 3, the length of the discrete length fibers 12 can be changed during the cutting operation by changing either the rate at which the continuous fibers 70 are fed to the cutting assembly 20, the speed at which the rotary cutters 22 are moved in orbit, or both the feed rate and the orbiting speed. FIG. 9 illustrates several discrete length fibers 88, 90, 92 cut to different lengths according to the method of the invention.

The method of forming discrete length fibers according to the invention prolongs the lifetime of the cutting blades compared to cutting with conventional choppers. Advantageously, the length of the discrete length fibers can be changed during the cutting operation by changing the feed rate or the orbiting speed, without significantly increasing the wear on the cutting blades. The orbiting motion of the first engagement member relative to the second engagement member creates a cutting action that causes reduced wear on the cutting blades. The motion of the rotary cutters 22 along the inner circumference 30 of the ring 26 in the embodiment shown in FIGS. 2 and 3 is particularly preferred. The rotation of the rotary cutters 22 on their own axes 68 as they orbit the ring further reduces wear on the cutting blades 24.

As shown in FIG. 2, after the continuous fibers 70 are cut to form the discrete length fibers 12, the discrete length fibers are ejected from the cutting assembly 20. The discrete length fibers can be ejected by any means suitable for removing the fibers from the cutting assembly. In the illustrated embodiment, the discrete length fibers 12 are ejected through four ejection conduits 94 (only two of which are shown in FIG. 2). The discrete length fibers are propelled through the ejection conduits by ejectors 96 mounted in the lower portion of the cutting assembly 20. Preferably, the ejection conduits have openings to allow the escape of some of the air or other fluid from the ejectors. In the illustrated embodiment, the openings 98 are provided by forming the ejection conduits as tubes that are open on one side (the tubes are semi-circular in cross-section).

Figure 10:
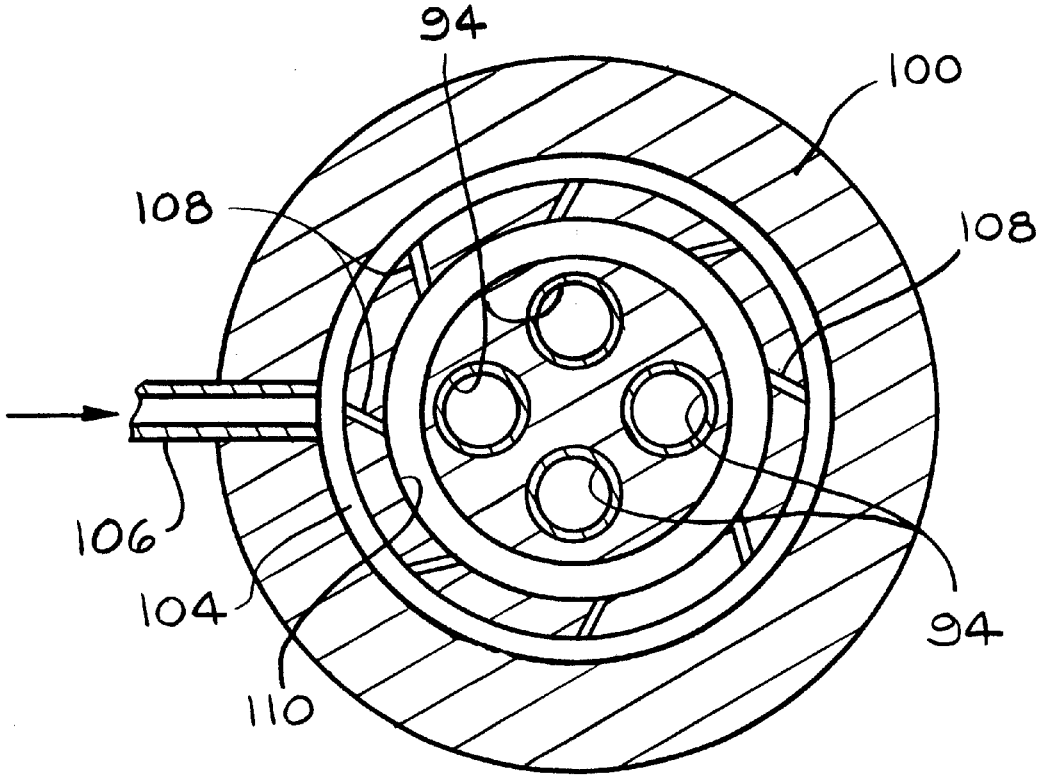
FIG. 10 is a plan view of the dispensing nozzle of FIG. 2, taken along line 10—10 of FIG. 2.

The discrete length fibers can be dispensed directly from the cutting assembly, or they can be dispensed by the use of a dispensing mechanism. In the embodiment illustrated in FIGS. 1, 2 and 10, the discrete length fibers 12 are dispensed from a nozzle 100 mounted at the end of the robot arm 16. As shown in FIGS. 2 and 10, the nozzle 100 is supplied at its upper end with streams of discrete length fibers 12 passing through the ejection conduits 94. The nozzle contains features that direct a fluid into the nozzle chamber 102 for the purpose of spreading out or flaring the streams of discrete length fibers in the nozzle. An annular manifold 104 is positioned to surround the ejection conduits. The manifold is supplied with a fluid via an inlet conduit 106 that extends through the nozzle wall. The fluid can be any material suitable for affecting the path of travel of the discrete length fibers in the nozzle, such as air, other gases, or liquids. The fluid is discharged from the manifold through discharge passageways 108 to an annular slot 1 10 that opens downwardly into the nozzle chamber 102. The discharge passageways are oriented such that the fluid is introduced into the nozzle chamber in a circumferential direction with respect to the longitudinal axis of the nozzle. This creates a vortex of swirling air, as indicated by the directional arrow 112, surrounding the discrete length fibers. The effect of the vortex is to cause the discrete length fibers traveling inside the nozzle to disperse into a wider stream. As the discrete length fibers exit the nozzle, the flow of the fibers is made wider by the action of the vortex. The angle of the flow of discrete length fibers dispensed from the nozzle can be controlled by controlling the fluid entering the nozzle.

Optionally, the discrete length reinforcement fibers can be resinated before they are dispensed, by any suitable means. The resin can be a thermoset resin, such as a polyester, epoxy, phenolic or polyurethane resin. The resin can also be a thermoplastic resin, such as a synthetic resin sold under the tradename NYRIM® or others.

Although the invention is illustrated in terms of cutting a continuous fiber between a ring and the cutting blades of rotary cutters, the invention could also be practiced by mounting a cutting blade in the ring and using rotary members to push the fiber against the cutting blade. In the embodiments of FIGS. 3 and 4, the rotary cutters move in orbits located inside and outside the ring. However, the rotary cutters could also move in an orbit having the same diameter as the ring, in which case the rotary cutters would have cutting blades directed toward the side surface of the ring. Other embodiments of the invention are also envisioned.

The principle and mode of operation of this invention have been described in its preferred embodiments. However, it should be noted that this invention may be practiced otherwise than as specifically illustrated and described without departing from its scope.

What is claimed is:

1. A method of forming discrete length fibers comprising the steps of:

positioning a first engagement member substantially coplanar with respect to a second engagement member wherein at least one of the first and second engagement members includes a cutter oriented in the plane of the first and second engagement members;

moving the first engagement member in orbit relative to the second engagement member;

positioning a continuous fiber, oriented generally perpendicular to the plane of the first and second engagement members, between the first engagement member and the second engagement member; and engaging the continuous fiber between the first engagement member and the second engagement member to cut the continuous fiber into discrete length fibers.

2. The method of claim 1 in which the second engagement member comprises a ring, and the continuous fiber is positioned and engaged between the first engagement member and the ring to cut the continuous fiber into discrete length fibers.

3. The method of claim 2 in which the continuous fiber is engaged between a curved cutting blade of the first engagement member and the ring to cut the continuous fiber into discrete length fibers.

4. The method of claim 2 in which the first engagement member is rotated on an axis while moving in orbit relative to the ring.

5. The method of claim 2 in which the continuous fiber is engaged between the first engagement member and an inner circumference of the ring to cut the continuous fiber into discrete length fibers.

6. The method of claim 2 in which the continuous fiber is engaged between the first engagement member and a side surface of the ring to cut the continuous fiber into discrete length fibers.

7. The method of claim 2 in which the positioning step comprises feeding the continuous fiber between the first engagement member and the ring, and in which a rate of feeding the continuous fiber is varied relative to a rate of moving the first engagement member to vary a length of the discrete length fibers.

8. The method of claim 2 in which the positioning step comprises pneumatically feeding the continuous fiber between the first engagement member and the ring.

9. The method of claim 2 comprising the additional step of pneumatically ejecting the discrete length fibers from the ring.

10. The method of claim 2 in which the cutting step comprises a shearing step.

11. A method of forming discrete length fibers comprising the steps of:

positioning a plurality of first engagement members substantially coplanar with respect to a second engagement member wherein at least one of the first and second engagement members includes a cutter oriented in the plane of the first and second engagement members;

moving the plurality of first engagement members in orbit relative to the second engagement member;

positioning a continuous fiber, oriented generally perpendicular to the plane of the first and second engagement members between one of the plurality of first engagement members, and the second engagement member; and engaging the continuous fiber between one of the plurality of first engagement members and the second engagement member to cut the continuous fiber into discrete length fibers.

12. The method of claim 11 in which the second engagement member comprises a ring, and the continuous fiber is positioned and engaged between the first engagement members and the ring to cut the continuous fiber into discrete length fibers.

13. The method of claim 12 in which the first engagement members are moved in orbit by rotation of an axle operatively connected to the first engagement members.

14. The method of claim 12 in which the continuous fiber is engaged between curved cutting blades of the first engagement members and the ring to cut the continuous fiber into discrete length fibers.

15. The method of claim 12 in which the first engagement members are rotated on axes while moving in orbit relative to the ring.

16. The method of claim 12 in which the continuous fiber is engaged between the first engagement members and an inner circumference of the ring to cut the continuous fiber into discrete length fibers.

17. The method of claim 12 in which the positioning step comprises feeding the continuous fiber between the first engagement members and the ring, and in which a rate of feeding the continuous fiber is varied relative to a rate of moving the first engagement members in orbit to vary a length of the discrete length fibers.

18. A method of forming discrete length fibers comprising the steps of:

positioning a plurality of first engagement members substantially coplanar with respect to a second engagement member wherein at least one of the plurality of the first and second engagement members includes a cutter oriented in the plane of the first and second engagement members;

moving the second engagement member in orbit relative to the plurality of first engagement members;

positioning a continuous fiber, oriented generally perpendicular to the plane of the first and second engagement members between the second engagement member and one of the plurality of first engagement members; and engaging the continuous fiber between the second engagement member and one of the plurality of first engagement members to cut the continuous fiber into discrete length fibers.

19. The method of claim 18 in which the second engagement member comprises a ring, and the continuous fiber is positioned and engaged between the ring and the first engagement members to cut the continuous fiber into discrete length fibers.

20. The method of claim 18 in which the continuous fiber is engaged between the ring and curved cutting blades of the first engagement members to cut the continuous fiber into discrete length fibers.

21. A method of forming discrete length fibers comprising the steps of:

positioning a first engagement member substantially coplanar with respect to a second engagement member wherein at least one of the first and second engagement members includes a cutter oriented in the plane of the first and second engagement members;

moving one of the first and second engagement members in orbit relative to the other engagement member such that the first engagement member engages the second engagement member;

positioning a continuous fiber, oriented generally perpendicular to the plane of the first and second engagement members, between the first and second engagement members while the first engagement member engages the second engagement member to cut the continuous fiber into a discrete length fiber.

22. The method of claim 21 in which the first engagement member comprises a curved cutting blade having an outer circumferential surface and the second engagement member comprises a ring having an inner circumferential surface.

23. The method of claim 22 in which the outer circumferential surface of the curved cutting blade engages the inner circumferential surface of the ring to cut the continuous fiber into the discrete length fiber.

24. The method of claim 21 in which the moving step comprises rotating the first engagement member about an axis while moving in orbit relative to the second engagement member.

25. The method of claim 21 in which a rate of feeding the continuous fiber is varied relative to a rate of moving the first engagement member to vary a length of the discrete length fiber.

26. The method of claim 21 in which the positioning step comprises pneumatically feeding the continuous fiber between the first engagement member and the second engagement member.

27. The method of claim 21 further comprising the step of pneumatically ejecting the discrete length fiber from the second engagement member.

* * * * *